US007298079B2

(12) United States Patent
Danjo et al.

(10) Patent No.: US 7,298,079 B2
(45) Date of Patent: Nov. 20, 2007

(54) ELECTRON SOURCE AND AN IMAGE DISPLAY DEVICE INCLUDING THE ELECTRON SOURCE

(75) Inventors: Keishi Danjo, Kanagawa (JP); Takashi Enomoto, Kanagawa (JP); Kouki Nukanobu, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 683 days.

(21) Appl. No.: 09/846,555

(22) Filed: Apr. 30, 2001

(65) Prior Publication Data

US 2001/0054865 A1 Dec. 27, 2001

(30) Foreign Application Priority Data

May 8, 2000 (JP) ..... 2000-134822

(51) Int. Cl.
*H01J 19/00* (2006.01)
*H01J 31/00* (2006.01)

(52) U.S. Cl. ..... 313/495; 313/512

(58) Field of Classification Search ..... 313/495–497, 313/309–311, 336, 553–555, 447 R, 549, 313/355, 512

See application file for complete search history.

(56) References Cited

U.S. PATENT DOCUMENTS 5,189,337 A * 2/1993 Endo et al. ..... 313/479
5,714,837 A * 2/1998 Zurn et al. ..... 313/495
5,742,118 A * 4/1998 Endo et al. ..... 313/479
5,791,961 A * 8/1998 Wang et al. ..... 445/50
5,831,387 A * 11/1998 Kaneko et al. ..... 313/495
5,894,187 A * 4/1999 Tomihari ..... 313/309
6,031,250 A * 2/2000 Brandes et al. ..... 257/77
6,087,770 A * 7/2000 Kaneko et al. ..... 313/495
6,184,610 B1 * 2/2001 Shibata et al. ..... 313/309
6,211,608 B1 * 4/2001 Raina et al. ..... 313/309
RE37,183 E * 5/2001 Kawamura et al. ..... 313/479
6,259,198 B1 * 7/2001 Yanagisawa et al. ..... 313/495
6,366,014 B1 * 4/2002 Kuroda et al. ..... 313/495
6,424,083 B1 * 7/2002 Tam et al. ..... 313/336
6,465,954 B1 * 10/2002 Kerslick et al. ..... 313/558
6,472,821 B1 * 10/2002 Hirokado et al. ..... 313/586
6,522,054 B2 * 2/2003 Shibata ..... 313/310
6,525,462 B1 * 2/2003 Kim ..... 313/496
6,538,368 B1 * 3/2003 Fox et al. ..... 313/311
6,586,872 B2 * 7/2003 Shibata ..... 313/495

* cited by examiner

*Primary Examiner*—Ashok Patel
(74) *Attorney, Agent, or Firm*—Fitzpatrick, Cella, Harper & Scinto

(57) ABSTRACT

A precursor to an electron source, having a capability for extending the life of an image display device by substantially preventing 1) a degradation in a degree of vacuum provided in an image display apparatus, 2) short-circuiting between adjacent wire electrodes via a getter, and 3) a degradation in performance characteristics of the electron source, even when used for a long time period. The electron source is for coupling to an image display member to form an image display apparatus, and the image display member is for displaying an image in response to being irradiated by electrons. The precursor preferably comprises a substrate, and an antistatic film provided on a surface of the substrate at a region where electron emitting devices are to be disposed on the precursor to form the electron source, but not on a region of that surface to be coupled to the image display member.

16 Claims, 7 Drawing Sheets

ELECTRON SOURCE AND AN IMAGE DISPLAY DEVICE INCLUDING THE ELECTRON SOURCE

BACKGROUND OF THE INVENTION

1. Field of the Invention

The present invention relates to a substrate for forming an electron source, an electron source using the substrate, and an image display device using the electron source.

2. Description of the Related Art

Two types of electron emitting devices, i.e., thermionic-cathode devices and cold-cathode devices, have been known. For example, surface-conduction-type devices, field-emission-type devices, metal/insulating layer/metal-type devices have been known as the cold-cathode devices.

The surface-conduction-type devices utilize the phenomenon that electron emission occurs by causing a current to flow in a direction parallel to the surface of a small-area thin film formed on a substrate. In the surface-conduction-type devices, electron emitting portions are formed by performing current-supply processing, called current-supply forming, on a conductive film before performing electron emission. That is, the current-supply forming processes supply current by applying a constant DC voltage or a DC voltage that increases at a very slow rate between both ends of a conductive film, to locally destruct or alter the conductive film in order to form electron emitting portions that have a high electric resistance. Cracks are generated at locally destructed, deformed or altered portions of the conductive film. When an appropriate voltage is applied to the conductive film after the current-supply forming, electron emission occurs at portions near the cracks.

An electron-source device includes the above-described electron emitting devices formed on a substrate wherein the electron emitting devices are wired in the form of a simple matrix by a plurality of row-direction wire electrodes and a plurality of column-direction wire electrodes. Particularly, an insulating layer is formed between electrodes at each of portions where the row-direction wire electrodes and the column-direction wire electrodes cross, in order to maintain electrical insulation. The above-described conductive film is formed in order to form electron emitting portions. By supplying current by applying a constant DC voltage or a DC voltage increasing at a very slow rate between both ends of the conductive film, the conductive film is locally destructed or altered in order to form electron emitting portions having a high electric resistance.

A phosphor film including phosphors is formed on a surface of a faceplate (a light-emitting display plate), connected so as to face the electron-source device, opposite to the electron-source device, and phosphors of three primary colors, i.e., red, green and blue, are appropriately coated. A black substance is provided between phosphors constituting the phosphor film, and a metal back made of Al or the like is formed on the phosphor film. The inside of an envelope obtained by connecting the faceplate and the electron-source device using a supporting frame is maintained to a vacuum of about $10^{-6}$ Torr. In order to provide the substrate with a strength sufficient enough to resist against the atmospheric pressure, a structural supporting member comprising a relatively thin glass plate is provided.

In an image display device in which phosphors are caused to emit light by projecting an electron beam emitted from an electron source onto an appropriate one of phosphors, serving as image display members, it is necessary to maintain the inside of an envelope including the electron source and the image display members of the faceplate in a high vacuum. This is because if a gas is generated within the envelope to increase the pressure within the envelope, the gas adversely influences the electron source to reduce the amount of electron emission although the degree of the influence depends on the type of the gas, and it becomes impossible to display a bright image. In some cases, the generated gas is ionized by the electron beam and damages the electron source due to the collision of the ionized gas with the electron source by being accelerated by an electron field for accelerating electrons. Alternatively, discharge may occur within the envelope, to sometimes destruct the device.

Usually, the envelope of the image display device is assembled by using a glass supporting frame and bonding connection portions by frit glass or the like, and the inside of the envelope is evacuated to a vacuum of about $10^{-7}$ Torr by connecting the inside of the envelope to a vacuum pump via an exhaust tube. Then, the exhaust tube is sealed. The vacuum after the sealing is maintained using a getter provided within the envelope. That is, a getter film is formed at a predetermined position within the envelope. The getter film is formed by heating and evaporating a getter material having, for example, Ba as a main component according to high-frequency heating. The inside of the envelope is maintained at a vacuum of about $10^{-6}$ Torr according to the adsorption function of the getter film.

In the above-described image display device, if a voltage is applied to electron emitting devices via external terminals, provided outside of the envelope, via the plurality of row-direction wire electrodes and the plurality of column-direction wire electrodes formed on the substrate for forming an electron source, an electron beam is emitted from each of the electron emitting devices. At the same time, by applying a high voltage of several tens of kV to the metal back formed on the phosphor film of the faceplate via a terminal provided outside of the envelope, the emitted electron beam is accelerated to impinge onto the phosphor film of the faceplate. The phosphors of the respective colors constituting the phosphor film are thereby excited to emit light, so that an image is displayed.

In some cases, in order to block diffusion of Na, a layer having $SiO_2$ as a main component is formed on a substrate containing Na, and an antistatic layer is formed on the substrate in order to prevent charging on the surface of the substrate.

However, the above-described image display device has the following problems.

First, the above-described coated layer formed on the substrate for forming an electron source may cause difficulty in maintaining the high-vacuum state within the envelope formed by connecting the substrate and the faceplate via the supporting frame, depending on the state of formation of the coated layer. It is estimated that this is because the inside of the coated layer may have gas permeability.

Second, the getter provided on the coated layer within the envelope in order to maintain a vacuum within the envelope may cause a short circuit between adjacent wire electrodes, even if the coated layer is made of an insulator. It is estimated that this is because a large number of bubbles are sometimes formed in the coated layer depending on the state of formation of the coated layer, and the bubbles are burst during heating at a high temperature to provide a state in which the wire electrodes are exposed. This short circuit may greatly degrade the quality of the formed image. Hence, in the worst case, the production yield of the image display device is degraded by manufacturing failed products.

SUMMARY OF THE INVENTION

It is an object of the present invention to provide precursor to an electron source which has a capability for extending the life of an image display device by preventing (or at least substantially minimizing) 1) a degradation in a degree of vacuum provided in an image display apparatus, 2) a short circuit between adjacent wire electrodes via a getter, and 3) a degradation in the performance characteristics of the electron source, even when used for a long period of time, and also to provide an electron source and an image display device using the precursor.

According to an aspect of the invention, a precursor to an electron source, which achieves the above-described object, is provided. The electron source is for being coupled to an image display member to form an image display apparatus, and the image display member is for displaying an image in response to being irradiated by electrons. According to one embodiment of the invention, the precursor comprises a substrate, and an antistatic film is provided on a surface of the substrate at a region where the electron emitting devices are to be disposed on the precursor to form the electron source, but not on a region of that surface which is to be coupled to the image display member.

According to another aspect of the invention, the above-described object is achieved by a precursor to an electron source, according to another embodiment of the invention, wherein the electron source is for being coupled to an image display member to form an image display apparatus, and the image display member is for displaying an image in response to being irradiated by electrons. The precursor according to this embodiment comprises a substrate, and a sodium blocking film provided on a surface of the substrate at a region where electron emitting devices are to be disposed on the precursor to form the electron source, but not on a region of that surface which is to be coupled to the image display member.

The above-described object is achieved by a precursor to an electron source according to another embodiment of the invention. As for the above-described embodiments, the electron source in this embodiment is for being coupled to an image display member to form an image display apparatus, and the image display member is for displaying an image in response to being irradiated by electrons. In the present embodiment of the invention, the precursor comprises a substrate, and an insulating film containing a metal oxide provided on a surface of the substrate at a region where the electron emitting devices are to be disposed on the precursor to form the electron source. Preferably, the insulating film is not provided on a region of that surface which is to be coupled to the image display member.

The above-described object also is achieved by a precursor to an electron source according to a further embodiment of the invention. As for the above-described embodiments, the electron source in this embodiment is for being coupled to an image display member to form an image display apparatus, and the image display member is for displaying an image in response to being irradiated by electrons. In the present embodiment of the invention, the precursor comprises a substrate and a $SiO_2$ film containing a metal oxide provided on a surface of the substrate at a region where the electron emitting devices are to be disposed on the precursor to form the electron source. Preferably, no portion of the $SiO_2$ film is provided on a region of that surface which is to be coupled to the image display member.

The above-described object also is achieved by another precursor to an electron source according to this invention. The precursor according to this embodiment of the invention comprises a substrate, and an antistatic film provided on a surface of the substrate at a region where electron emitting devices are to be disposed on the precursor, but not on a region of that surface where a getter film is to be disposed to form the electron source.

According to still another embodiment of the invention which achieves the above-described object, a precursor to an electron source is provided which comprises a substrate, and a sodium blocking film provided on a surface of the substrate at a region where the electron emitting devices are to be disposed on the precursor, but not on a region of that surface where a getter film is to be disposed to form the electron source.

According to further embodiment of the invention which achieves the above-described object of the invention, a precursor to an electron source is provided which comprises a substrate, and an insulating film containing a metal oxide. The insulating film is provided on a surface of the substrate at a region where the electron emitting devices are to be disposed on the precursor, but not on a region of that surface where a getter film is to be disposed to form the electron source.

According to further embodiment of the invention which achieves the above-described object of the invention, a precursor to an electron source is provided which comprises a substrate, and a $SiO_2$ film containing a metal oxide. The $SiO_2$ film is provided on a surface of the substrate at a region where the electron emitting devices are to be disposed on the precursor, but is not provided on a region of that surface where a getter film is to be disposed to form the electron source.

According to still another aspect of the invention, the above-described object is achieved by a precursor to an electron source, wherein the electron source is for being coupled to an image display member to form an image display apparatus, and the image display member is for displaying an image in response to being irradiated by electrons. The precursor comprises a substrate, and an antistatic film provided on a surface of the substrate at a region where electron emitting devices are to be disposed on the precursor. Preferably, the antistatic film is not provided on a region of that surface which is to be coupled to the image display member and a region of that surface where a getter film is to be disposed to form the electron source.

According to still another aspect of the invention, the above-described object is achieved by a precursor to an electron source, wherein the electron source is for being coupled to an image display member to form an image display apparatus, and the image display member is for displaying an image in response to being irradiated by electrons. The precursor comprises a substrate, and a sodium blocking film provided on a surface of the substrate at a region where electron emitting devices are to be disposed on the precursor. Preferably, the sodium blocking film is not provided on a region of that surface which is to be coupled to the image display member and a region of that surface where a getter film is to be disposed to form the electron source.

According to still another aspect of the invention, the above-described object is achieved by a precursor to an electron source, wherein the electron source is for being coupled to an image display member to form an image display apparatus, and the image display member is for displaying an image in response to being irradiated by electrons. The precursor comprises a substrate, and an insulating film containing a metal oxide provided on a surface of the substrate at a region where electron emitting devices are to be disposed on the precursor, but not on a region of that surface which is to be coupled to the image display member and a region of that surface where a getter film is to be disposed to form the electron source.

According to still another aspect of the invention, the above-described object is achieved by a precursor to an electron source, wherein the electron source is for being coupled to an image display member to form an image display apparatus, and the image display member is for displaying an image in response to being irradiated by electrons. The precursor comprises a substrate, and a $SiO_2$ film containing a metal oxide provided on a surface of the substrate at a region where electron emitting devices are to be disposed on the precursor, but not on a region of that surface which is to be coupled to the image display member and a region of that surface where a getter film is to be disposed to form the electron source.

According to still another aspect of the invention, an electron source is provided which achieves the above-described object of the invention. The electron source comprises a precursor according to any of the embodiments of a precursor described above, and also comprises electron emitting devices disposed on the precursor.

According to a further aspect of the present invention, an image display device is provided which achieves the above-described object of the invention. The image display device preferably comprises an electron source that includes a precursor according to any of the embodiments of a precursor described above, and electron emitting devices disposed on the precursor. The image display device preferably also comprises an image display member for displaying an image in response to being irradiated by electrons emitted from the electron emitting devices.

The foregoing and other objects, advantages and features of the present invention will become more apparent from the following detailed description of the preferred embodiments taken in conjunction with the accompanying drawings.

DETAILED DESCRIPTION OF THE PREFERRED EMBODIMENTS

Figure 1:
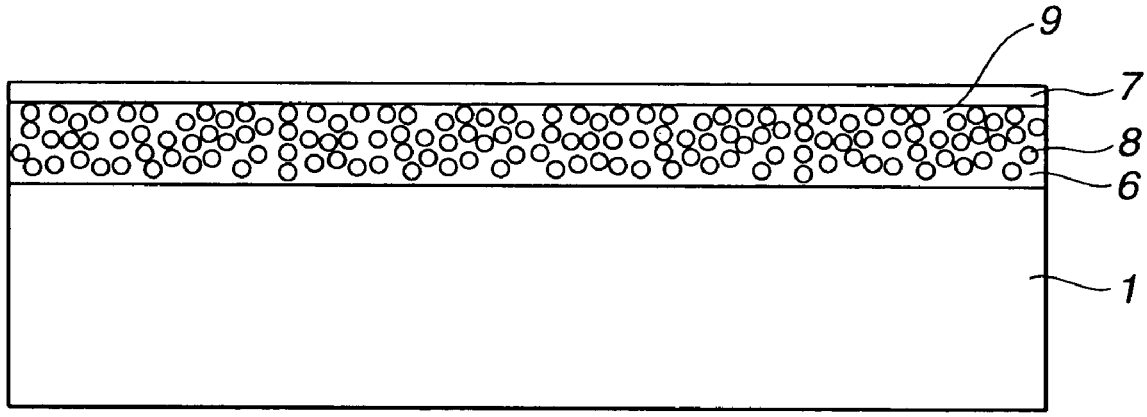
FIG. 1 a schematic cross-sectional view illustrating a precursor to an electron source according to the present invention.

According to an aspect of the invention, a precursor to an electron source is provided. The electron source preferably is for being coupled to an image display member to form an image display apparatus, and the image display member is for displaying an image in response to being irradiated by electrons. According to one embodiment of the invention, the precursor is characterized in that it comprises a substrate, and an antistatic film provided on a surface of the substrate at a region where the electron emitting devices are to be disposed on the precursor to form the electron source. The antistatic film preferably is not provided on a region of that surface which is to be coupled to the image display member. Preferably, the antistatic film contains conductive particles.

According to another embodiment of the invention, a precursor to an electron source is provided, wherein the electron source is for being coupled to an image display member to form an image display apparatus, and the image display member is for displaying an image in response to being irradiated by electrons. The precursor according to this embodiment of the invention is characterized in that it comprises a substrate, and a sodium blocking film provided on a surface of the substrate at a region where electron emitting devices are to be disposed on the precursor to form the electron source, but not on a region of that surface which is to be coupled to the image display member. Preferably, the sodium blocking film contains sodium blocking particles.

According to another embodiment of the invention, another precursor to an electron source is provided, wherein the electron source is for being coupled to an image display member to form an image display apparatus, and the image display member is for displaying an image in response to being irradiated by electrons. The precursor according to this embodiment is characterized in that it comprises a substrate, and an insulating film containing a metal oxide provided on a surface of the substrate at a region where the electron emitting devices are to be disposed on the precursor to form the electron source. The insulating film preferably is not provided on a region of that surface which is to be coupled to the image display member.

According to another embodiment in the invention, a further precursor to an electron source is provided, wherein the electron source is for being coupled to an image display member to form an image display apparatus, and the image display member is for displaying an image in response to being irradiated by electrons. In the present embodiment of the invention, the precursor is characterized in that it comprises a substrate, and a $SiO_2$ film containing a metal oxide provided on a surface of the substrate at a region where the electron emitting devices are to be disposed on the precursor to form the electron source. Preferably, the $SiO_2$ film is not provided on a region of that surface which is to be coupled to the image display member, and the precursor also comprises another film comprising $SiO_2$ laminated on the $SiO_2$ film, although in other embodiments that other film need not be employed.

According to another embodiment of the invention, another precursor to an electron source is provided. The precursor according to this embodiment is characterized in that it comprises a substrate and an antistatic film provided on a surface of the substrate at a region where electron emitting devices are to be disposed on the precursor, but not on a region of that surface where a getter film is to be disposed to form the electron source.

A precursor to an electron source, according to another embodiment of the invention, is characterized in that it comprises a substrate and a sodium blocking film provided on a surface of the substrate at a region where the electron emitting devices are to be disposed on the precursor, but not on a region of that surface where a getter film is to be disposed to form the electron source.

According to further embodiment of the invention, a precursor to an electron source is provided. The precursor according to this embodiment is characterized in that it comprises a substrate and an insulating film containing a metal oxide provided on a surface of the substrate at a region where the electron emitting devices are to be disposed on the precursor. Preferably, the insulating film is not on a region of that surface where a getter film is to be disposed to form the electron source.

According to further embodiment of the invention, still another precursor to an electron source is provided. The precursor according to this embodiment is characterized in that it comprises a substrate, and a $SiO_2$ film containing a metal oxide provided on a surface of the substrate at a region where the electron emitting devices are to be disposed on the precursor. Preferably, the $SiO_2$film is not provided on a region of that surface where a getter film is to be disposed to form the electron source, an the precursor also comprises another film including $SiO_2$ laminated on the $SiO_2$ film, although in other embodiments, that other film need not be employed.

According to another embodiment of the present invention, a precursor to an electron source is provided, wherein the electron source is for being coupled to an image display member to form an image display apparatus, and the image display member is for displaying an image in response to being irradiated by electrons. The precursor according to this embodiment is characterized in that it comprises a substrate and an antistatic film provided on a surface of the substrate at a region where electron emitting devices are to be disposed on the precursor. Preferably, the antistatic film is not provided on a region of that surface which is to be coupled to the image display member and a region of that surface where a getter film is to be disposed to form the electron source. Also in the preferred embodiment, the antistatic film is a charging prevention film containing conductive particles.

In accordance with another embodiment of the invention, another precursor to an electron source is provided. The electron source is for being coupled to an image display member to form an image display apparatus, and the image display member is for displaying an image in response to being irradiated by electrons. The precursor according to this embodiment is characterized in that it comprises a substrate and a sodium blocking film provided on a surface of the substrate at a region where electron emitting devices are to be disposed on the precursor. Preferably, the sodium blocking film is not provided on a region of that surface which is to be coupled to the image display member and a region of that surface where a getter film is to be disposed to form the electron source. Also in the preferred embodiment, the sodium blocking film contains sodium blocking particles.

According to another embodiment of the invention, a precursor to an electron source is provided which is characterized in that the precursor comprises a substrate and an insulating film containing a metal oxide provided on a surface of the substrate at a region where electron emitting devices are to be disposed on the precursor. Preferably, the insulating film is not provided on a region of that surface which is to be coupled to the image display member and a region of that surface where a getter film is to be disposed to form the electron source. The electron source is for being coupled to an image display member to form an image display apparatus, and the image display member is for displaying an image in response to being irradiated by electrons.

According to another aspect of the invention, a further precursor to an electron source is provided, wherein the electron source is for being coupled to an image display member to form an image display apparatus, and the image display member is for displaying an image in response to being irradiated by electrons. The precursor according to this embodiment is characterized in that it comprises a substrate, and a $SiO_2$ film containing a metal oxide provided on a surface of the substrate at a region where electron emitting devices are to be disposed on the precursor. Preferably, the $SiO_2$ film is not provided on a region of that surface which is to be coupled to the image display member and a region of that surface where a getter film is to be disposed to form the electron source. The precursor preferably also comprises another film of $SiO_2$ film laminated on the $SiO_2$ film, although in other embodiments that other film need not be employed.

Preferably, the metal oxide employed in the precursors of this invention is particulate, electron-conductive, and is an oxide of a metal selected from the group consisting of Fe, Ni, Cu, Pd, Ir, In, Sn, Sb and Re.

The electron source according to the present invention is characterized in that it includes a precursor according to any of the embodiments of a precursor described above, and electron emitting devices disposed on the precursor.

In the electron source according to the present invention, it is preferable that the electron emitting devices each include a conductive film including at least one corresponding electron emitting portion, and the electron emitting devices are preferably wired in a matrix configuration by a plurality of row-direction wires and a plurality of column-direction wires.

According to a further aspect of the present invention, an image display device is provided. The image display device is characterized in that it comprises an electron source that includes a precursor according to any of embodiments of a precursor described above, and also comprises electron emitting devices disposed on the precursor. The image display device also comprises an image display member for displaying an image in response to being irradiated by electrons emitted from the electron emitting devices.

The image display device of this present invention preferably also comprises a supporting frame (member) which couples the electron source to the image display member. Also, the electron emitting devices of the image display device preferably each comprises a conductive film that includes at least one corresponding electron emitting portion, and preferably are wired together in a matrix configuration through a plurality of row-direction wires and a plurality of column-direction wires.

Preferably, the above-described antistatic film, $SiO_2$ film, and insulating film each include a plurality of particulate substances (particles), and the particulate substances (particles) each have a particle diameter that is at least 6 nm, and within a range of 6 nm-60 nm. It also is preferable that the antistatic film formed on the substrate has a sheet resistance within a range of $10^8\Omega/\square$-$10^{13}\Omega/\square$.

The present invention will now be described in detail with reference to the drawings.

FIG. 1 is a cross-sectional view illustrating a precursor to an electron source. In FIG. 1, a substrate 1 comprises soda-lime glass containing Na, high-strain-point glass in which the strain point is increased by replacing part of Na by K, or the like. A second layer 6 contains a metal oxide, such as an electron-conductive metal oxide, and serves as a charging prevention (antistatic) layer, a sodium blocking layer, an insulating film containing a metal oxide, or a $SiO_2$ layer containing a metal oxide, depending on which embodiment of the precursor is employed. A first layer 7 preferably contains $SiO_2$ as a main component, and is formed on the second layer 6. Reference numeral 8 represents electron-conductive oxide particles, serving as the metal oxide (when employed) within the second layer 6. Reference numeral 9 represents voids within the second layer 6.

Figure 2A:
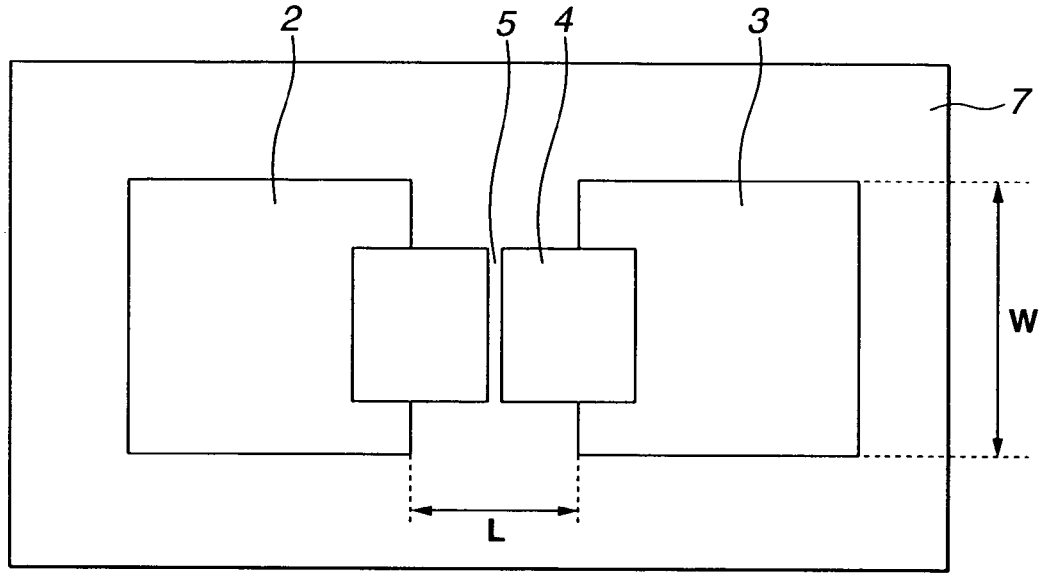
FIGS. 2A and 2B are a schematic plan view and a schematic cross-sectional view, respectively, illustrating an electron emitting device mounted in the precursor of FIG. 1, according to the present invention.
Figure 2B:
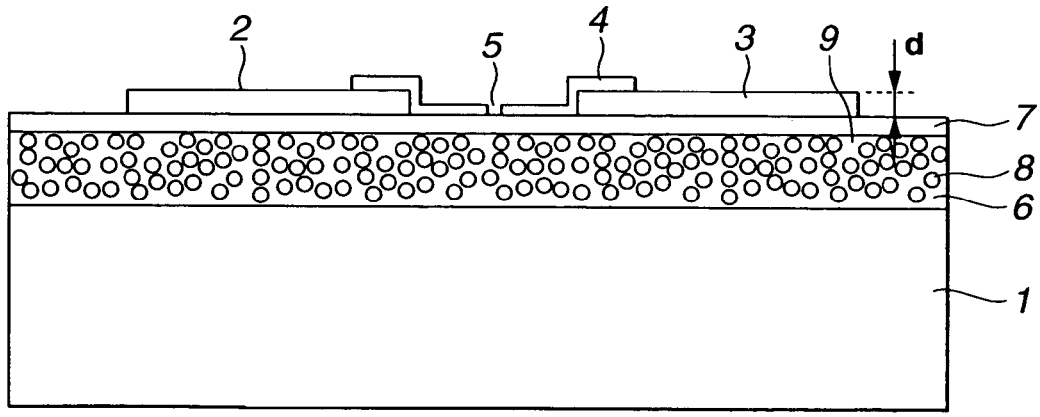

As shown in FIGS. 2A and 2B, each electron emitting device is formed on the first layer 7. The second layer 6 is provided mainly for blocking diffusion of Na into members constituting the electron emitting device, particularly, a conductive film 4. By forming the second layer 6 on the substrate 1 containing Na, diffusion of Na from the substrate 1 is suppressed. The thickness of the second layer 6 is preferably at least 300 nm for suppressing the diffusion of Na, and, more preferably, is equal to or less than 3 μm for preventing the generation of cracks or peeling of the film due to the stress in the film. The metal oxide contained in the second layer 6 is preferably particulate, and also is preferably electron-conductive. More specifically, an oxide of a metal selected from the group consisting of Fe, Ni, Cu, Pd, Ir, In, Sn, Sb and Re is preferably included in the layer 6, and an oxide of Sn is even more preferable in that layer 6. Since the first layer 7 contains $SiO_2$ as a main component, it is preferable that the second layer 6 also contains $SiO_2$. The particle diameter of metal-oxide particles 8 is preferably 6 nm-60 nm.

The first layer 7 contains $SiO_2$ as a main component, and is provided whenever necessary, in order to improve the flatness of the surface of the precursor at a region thereof, where the electron emitting devices are to be formed, to prevent particles of the electron-conductive oxide within the second layer 6 from escaping, and to prevent diffusion of Na. The first layer 7 is formed on the second layer 6 so as to cover projections and recesses provided by the particles 8 of the electron-conductive oxide, so that the flatness is improved (i.e., to provide a substantially planer, flat surface) and the electron emitting devices can be easily formed on the layer 7. Since it is difficult to bond the electron conductive oxide to the substrate 1 when only the second layer 6 is employed, the first layer 7 preferably also is employed and assists in bonding the electron conductive oxide to the substrate 1, and prevents the particles of the electron conductive oxide from escaping. The first layer 7 also has the effect of suppressing diffusion of Na from the substrate 1 into the electron emitting devices. The thickness of the first layer 7 preferably is at least 40 nm for improving the flatness, and more preferably is at least 60 nm for preventing diffusion of Na, and, still more preferably is equal to or less than 3μ for preventing the generation of cracks and peeling of the film due to the stress in the film.

Figure 7:
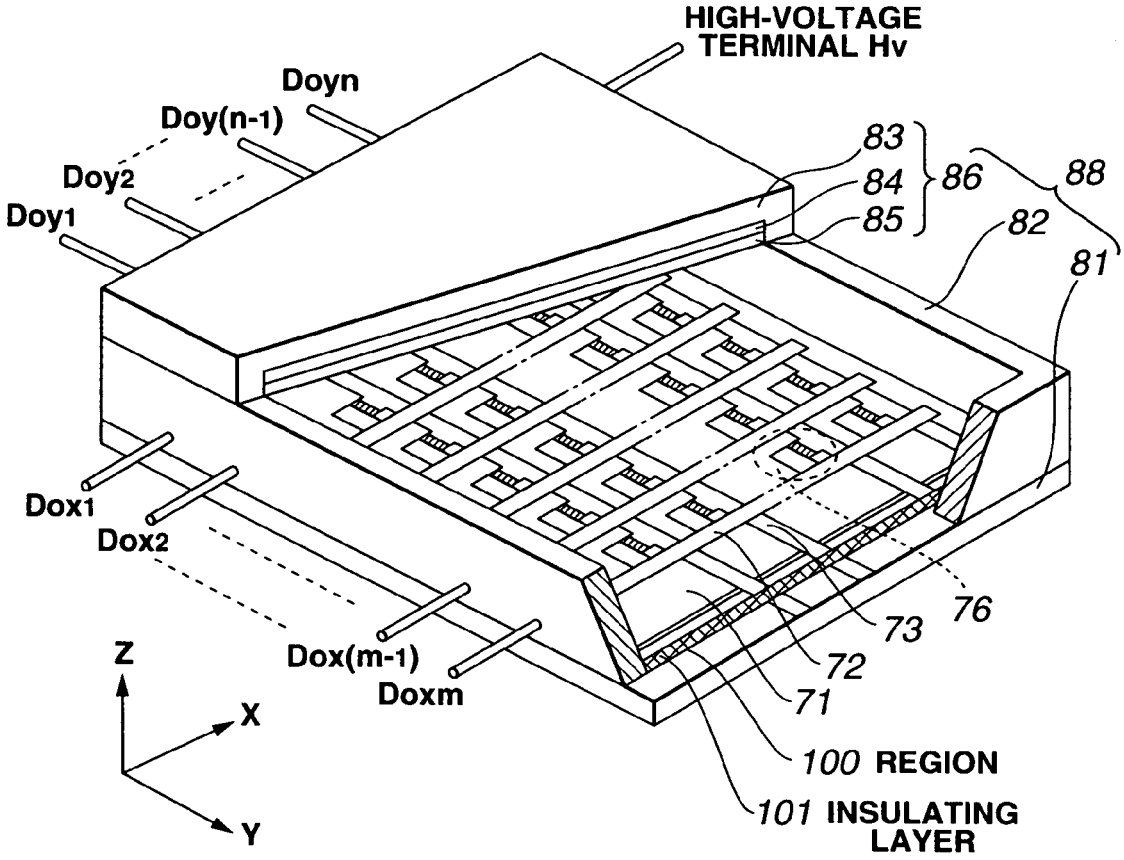
FIG. 7 is a schematic diagram illustrating the configuration of an image display device according to the present invention.

FIG. 7 is a diagram illustrating an image display device according to the present invention. In FIG. 7, an electron-source substrate 81 has formed thereon a plurality of surface-conduction-type electron emitting devices 76 disposed in the form of a matrix and connected together by m row-direction wires 72 and n column-direction wires 73 on the substrate 81, wherein those components collectively form an electron source according to the invention. A faceplate 86 includes a phosphor film 84 and a metal back 85 formed on the inner surface of glass 83. A supporting frame 82 connects the electron-source substrate 81 and the faceplate 86, and preferably comprises frit glass having a low melting point, or the like, to provide an envelope 88 of the image display device.

The electron emitting devices 76 are electrically connected to the m row-direction wires 72 and the n column-direction wires 73. Operation-signal applying means (not shown) for applying an operation signal for selecting a row of the electron emitting devices 76 arranged in the x direction is connected to the row-direction wires 72. Modulation-signal applying means (not shown) for modulating each column of the electron emitting devices 76 arranged in the y direction in accordance with an input signal is connected to the column-direction wires 73. A driving voltage is applied via both signal applying means to each electron emitting device 76 as a difference voltage between the operation signal and the modulation signal applied to the concerned device.

As shown in FIG. 7, on the substrate 81 of the electron source according to the present invention, a second layer 71 (similar to layer 6 in FIG. 1) is, more preferably a first layer (like layer 7, not shown in FIG. 7) and the second layer 71 are disposed on a portion of the substrate 81, but are not provided at a region of the substrate 81 where the substrate 81 couples with another member constituting the envelope 88, such as the supporting frame 82 or the like (i.e., a member coupling the substrate 81 to element 86, or, if not such member is employed and the devices 81 and 86 are coupled together directly, the element 86). Accordingly, the supporting frame 82 is directly connected to the glass surface of the substrate 81 at the sealing region thereof. Hence, air does not leak from the second layer 71 having gas permeability into the envelope 88, since the layer 71 and frame 82 are not directly connected together.

By providing the second layer 71, more preferably the first layer and the second layer 71 on a surface of the electron-source substrate 81 at a region where the electron emitting devices 76 are disposed on an upper one of those layers (although, for convenience, only the layer 71 is shown in FIG. 7), except for a region 100 where a getter film is disposed, bubbles are not generated within the insulating layer 6 even if heating processing at a temperature as high as 300° C. is performed at a post-process, and short circuit between adjacent wire electrodes 73 via a getter due to formation of the getter film as a result of exposure of the electrodes 73 from insulating layer 101 does not occur.

The present invention will now be described in the context of an example. However, the present invention is not limited to such an example, but also includes cases in which components are replaced and design is changed according to predetermined criteria within a range of achievement of the object of the invention.

Using the precursor to an electron source shown in FIG. 1, the image display device shown in FIG. 7, which includes electron emitting devices as shown in FIGS. 2A and 2B, was manufactured, as will now be described.

First, the precursor to an electron source shown in FIG. 1 was formed.

A mixed solution (hereinafter termed a "PTO") of $SnO_2$ fine particles whose resistance was adjusted by doping phosphorus and an organosilicic compound was coated on a predetermined, partial region of the subbsrate 1 except for a sealing region of high-strain-point glass (containing $SiO_2$:

58%, $Na_2O$: 4%, and $K_2O$: 7%), serving as the substrate 1 and the supporting frame 82, i.e., a region inside of the connection portion of the supporting frame 82, using a slit coater, and was dried on a hot plate at 80° C. for 3 minutes. The coated layer was used as the second layer 6.

Then, a solution containing only the organosilicic compound was coated on the second layer 6 using a slit coater, and was dried on a hot plate at 80° C. for 3 minutes. The coating layer was used as the first layer 7.

Then, the coated substrate 1 was fired at 500° C. for 60 minutes. As a result, the second layer 6 having a thickness of 300 nm, in which the $SnO_2$ fine particles (whose resistance was adjusted by doping phosphorus and $SnO_2$) were contained with a weight ratio of 80:20, was formed on the high-strain-point glass substrate 1, and the first layer 7 having a thickness of 60 nm which comprises $SiO_2$ was formed on the second layer 6.

Then, an electron-source like the one shown in FIG. 7 was formed by forming surface-conduction-type electron emitting devices on the coated substrate, as shown in FIGS. 2A and 2B and FIGS. 5A-5D, as will now be described.

First, device electrodes 2 and 3 were formed on layer 7 in the following manner. A photoresist layer was formed on the layer 7, and openings were formed in the photoresist layer according to photolithography to form the desired shape of the electrodes. Then, a Ti film 5 nm thick and a Pt film 10 nm thick were formed according to sputtering, and the photoresist layer was removed by being dissolved by an organic solvent, to form the device electrodes 2 and 3 according to lift-off (see FIG. 5B). At that time, an interval L between device electrodes and a width W of the electrodes 2 and 3 shown in FIG. 2A were 20 μm and 600 μm, respectively.

Then, row-direction wires 72 were formed according to screen printing, using a paste material (not shown) containing silver as a metal component (NP-4736S made by Noritake Co., Limited). The m row-direction wires 72 comprise $D_{0x1}$, $D_{0x2}$, —, $D_{0xm}$. After the screen printing, the printed paste material was dried at 110° C. for 20 minutes, and was then fired at a peak temperature of 500° C. for a peak holding time period of 5 minutes in a heat treating apparatus, to form the row-direction wires 72 having a thickness of 5 μm.

Then, an insulating layer (not shown) between the row-direction wires 72 and the column-direction wires 73 was formed. In order to form the insulating layer, an insulating paste material (not shown) was printed at positions on the row-direction wires 72 where the row-direction wires 72 are to cross the column-direction wires 73, according to screen printing. After the screen printing, the printed insulating-paste material was fired at a peak temperature of 500° C. for 10 minutes, to form an insulating layer 20 μm thick.

Then, the column-direction wires 73 were formed in the same manner as in the case of the row-direction wires 72 except along a different direction. The column-direction wires 73 comprise n wires, i.e., $D_{0y1}$, $D_{0y2}$, —, $D_{0yn}$. An electron-source substrate in which the row-direction wires 72 and the column-direction wires 73 were arranged in the form of a matrix was thus manufactured.

Then, a conductive film 4 was formed between each pair of device electrodes 2 and 3 (see FIG. 5C) in the following manner. First, a solution containing an organic compound of palladium was coated over the electrodes 2 and 3 for a width of 100 μm using a bubble-jet-type ink-jet apparatus. Then, the coated solution was heated at 300° C. for 30 minutes to provide the conductive film 4 comprising palladium oxide fine particles. In order to provide excellent electron emission characteristics, the conductive film 4 preferably contains a film comprising a plurality of fine particles having a particle diameter within a range of 1 nm-20 nm. The thickness of the conductive film 4 preferably is within a range of 1 nm-50 nm.

Figure 5A:
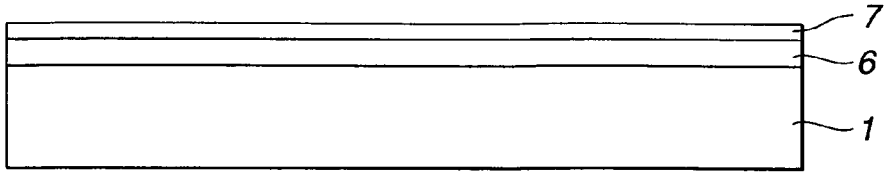
FIGS. 5A-5D are schematic diagrams illustrating a procedure for manufacturing an electron-source substrate according to the present invention.
Figure 5B:
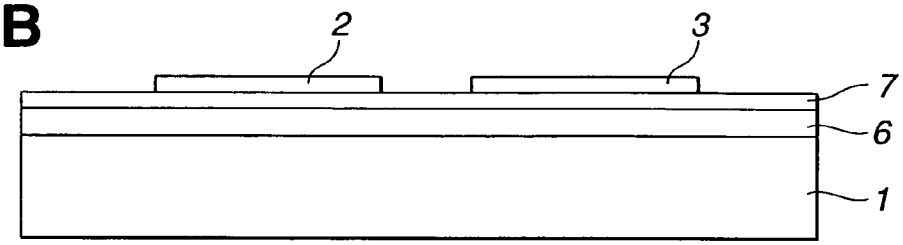
Figure 5C:
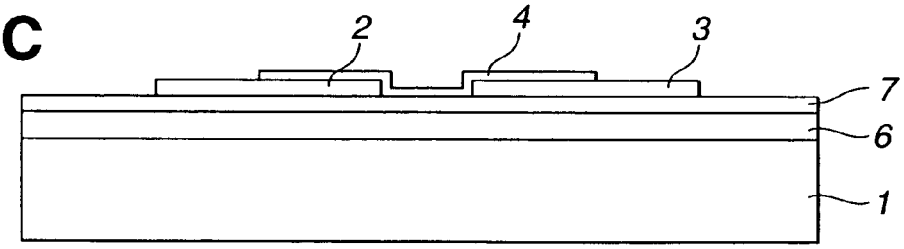
Figure 5D:
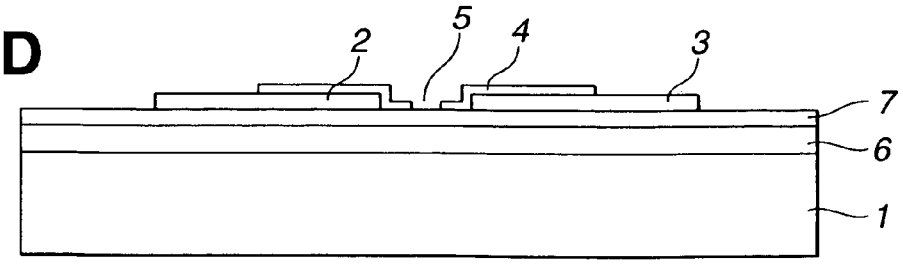

An electron emitting portion (gap) 5 was obtained, for example, by forming a crack in the conductive film 4 formed between the device electrodes 2 and 3 according to forming processing (to be described below) (see FIG. 5D).

Figure 3A:
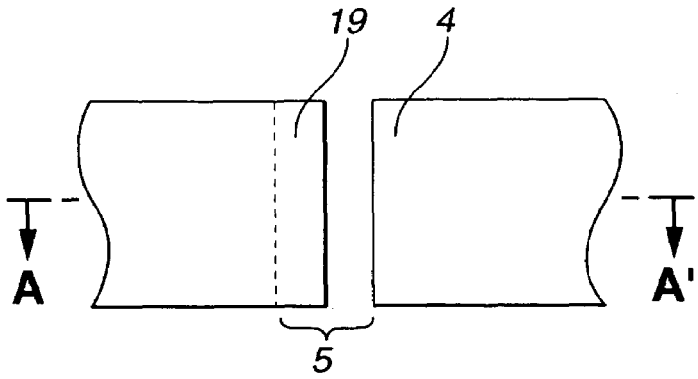
FIGS. 3A and 3B are a partially enlarged schematic plan view and a partially enlarged schematic cross-sectional view, respectively, illustrating a surface-conduction-type electron emitting device of an electron source according to the present invention.
Figure 3B:
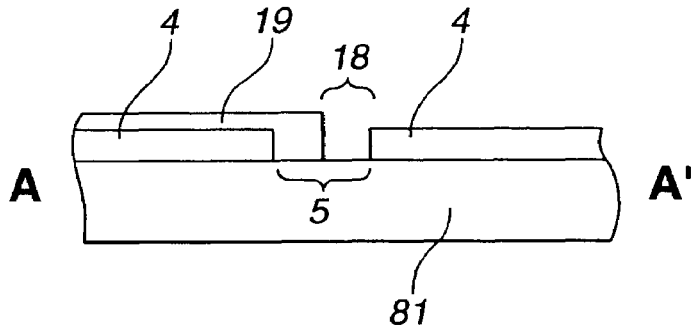
Figure 4A:
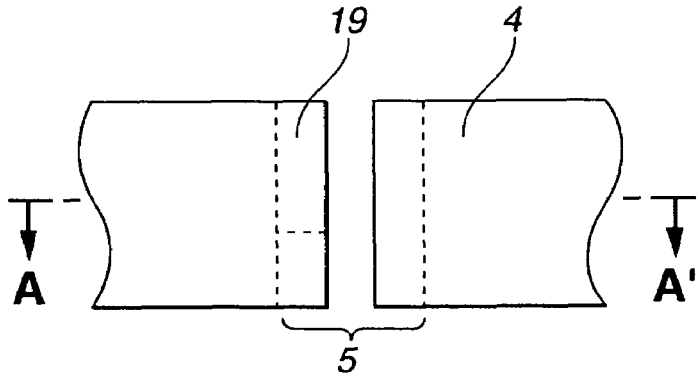
FIGS. 4A and 4B are a partially enlarged schematic plan view and a partially enlarged schematic cross-sectional view, respectively, illustrating another surface-conduction-type electron emitting device of an electron source according to the present invention.
Figure 4B:
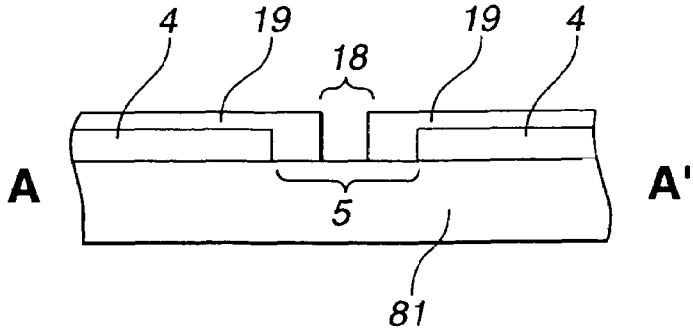

It is preferable that a carbon film is formed on the conductive film 4, for improving the electron emission characteristics and to reduce temporal changes in the electron emission characteristics. The carbon film is formed, for example, as shown in FIGS. 3A and 3B. FIG. 3A is an enlarged schematic plan view of a surrounding portion of the gap 5 in the conductive film 4 of a surface-conduction-type electron emitting device having the carbon film, and FIG. 3B is a cross-sectional view taken along line A-A' shown in FIG. 3A. As shown in FIGS. 3A and 3B, the surface-conduction-type electron emitting device includes a carbon film 19 on both the substrate 81 within the gap 5 and the conductive film 4 so as to form a gap 18 narrower than the gap 5 formed between portions of the conductive film 4 in a state of being connected to the conductive film 4. Alternatively, the same effects as in the above-described configuration may be obtained, as shown in FIGS. 4A and 4B, by forming carbon films 19 on the portions of the conductive films 4 so as to provide a gap 18.

Figure 8:
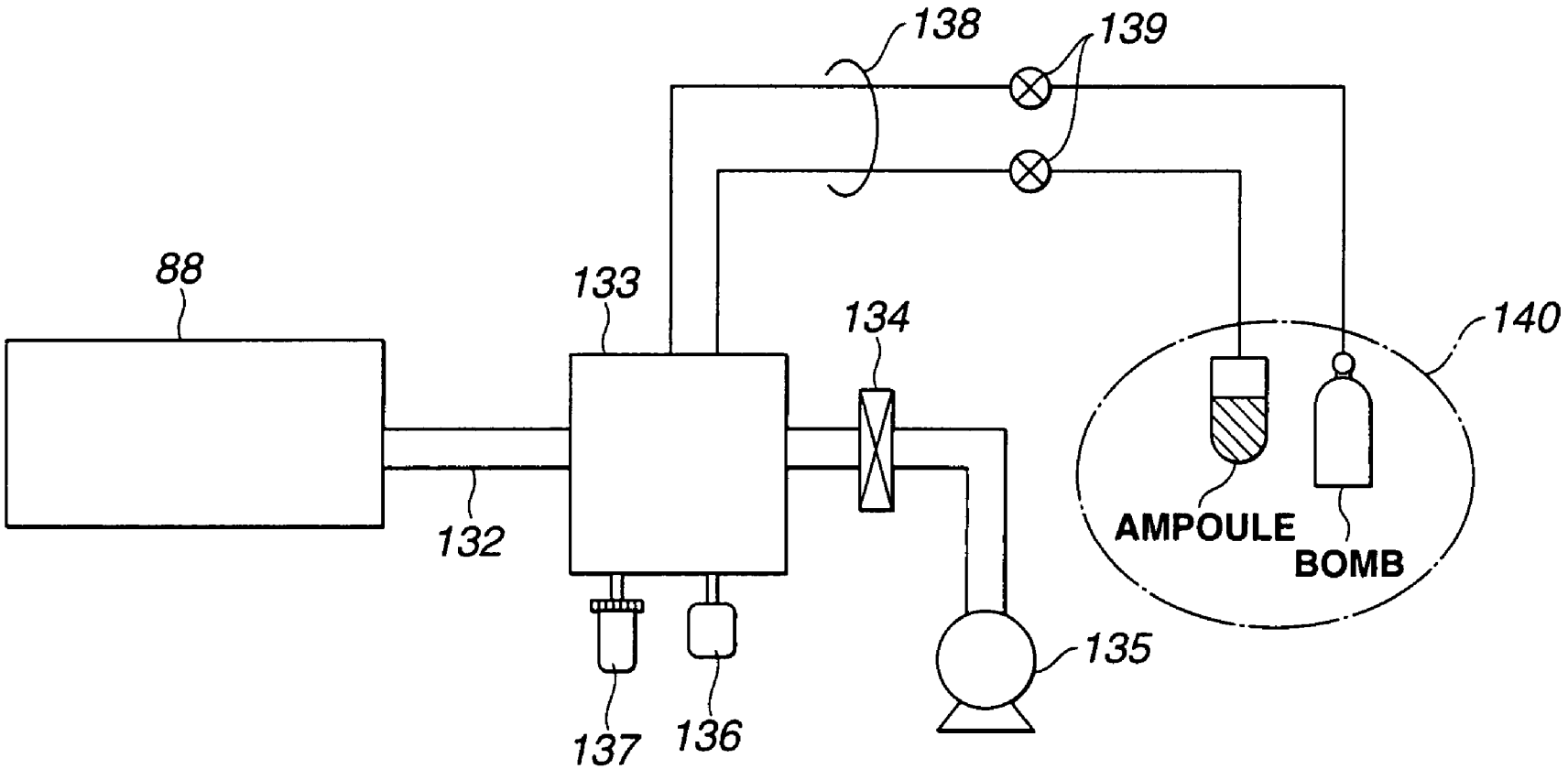
FIG. 8 is a schematic diagram illustrating an outline of an apparatus used for manufacturing an image display device according to this invention.

Next, a description will be provided of a preferred method for manufacturing the image display device shown in FIG. 7. FIG. 8 is a schematic diagram of an apparatus used in this method. In FIG. 8, the envelope 88 is connected to a vacuum chamber 133 via an exhaust tube 132, and is further connected to an evacuation apparatus 135 via a gate valve 134. A pressure gauge 136, a quadrupole mass spectrometer 137 and the like are mounted within the vacuum chamber 133, in order to measure the inner pressure and the partial pressures of respective gas components. Since it is difficult to directly measure the pressure within the envelope 88, processing conditions are controlled by measuring, for example, the pressure within the vacuum chamber 133. Gas introducing lines 138 are connected to the vacuum chamber 133, in order to control the atmosphere within the vacuum chamber 133 by introducing necessary gases into the vacuum chamber 133. Sources 140 of substances to be introduced into chamber 133 are connected to respective ends of the gas introducing lines 138. The substances to be introduced are stored in ampoules, bombs or the like. Introduced-amount control means 139 for controlling the rate of gas introduction is provided at a mid section of each of the gas introducing lines 138. Preferably, a valve capable of controlling a gas flow rate, such as a slow leakage valve, a mass-flow controller, or the like may be used as the introduced-amount control means 139, depending on the type of the substance to be introduced.

The inside of the envelope 88 is evacuated by the apparatus shown in FIG. 8, and the forming processing is performed. Current-supply forming will now be described as an example of the forming processing. By supplying current between the device electrodes 2 and 3 using a power supply (not shown), the electron emitting portion 5 is formed on the conductive film 4.

Figure 6A:
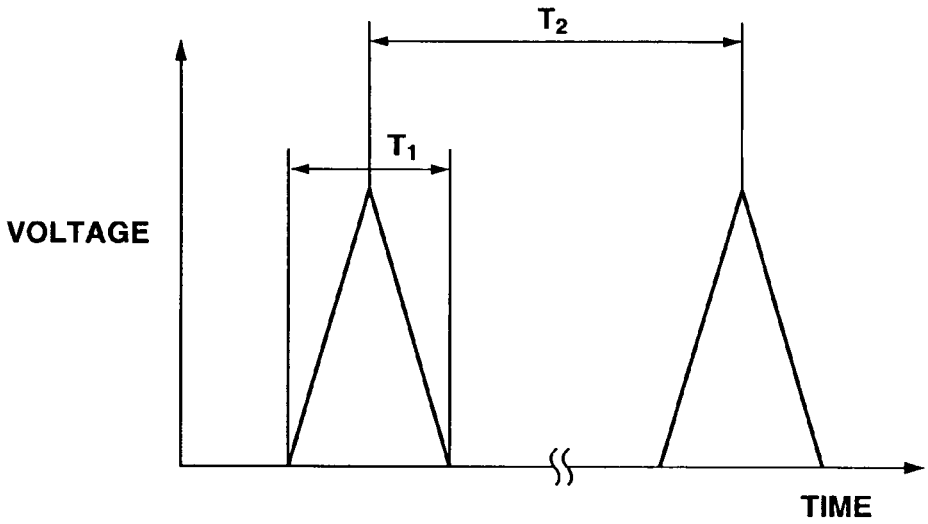
FIGS. 6A and 6B are schematic graphs, each illustrating the waveforms of pulse voltages used in the manufacture of an electron source according to the present invention.
Figure 6B:
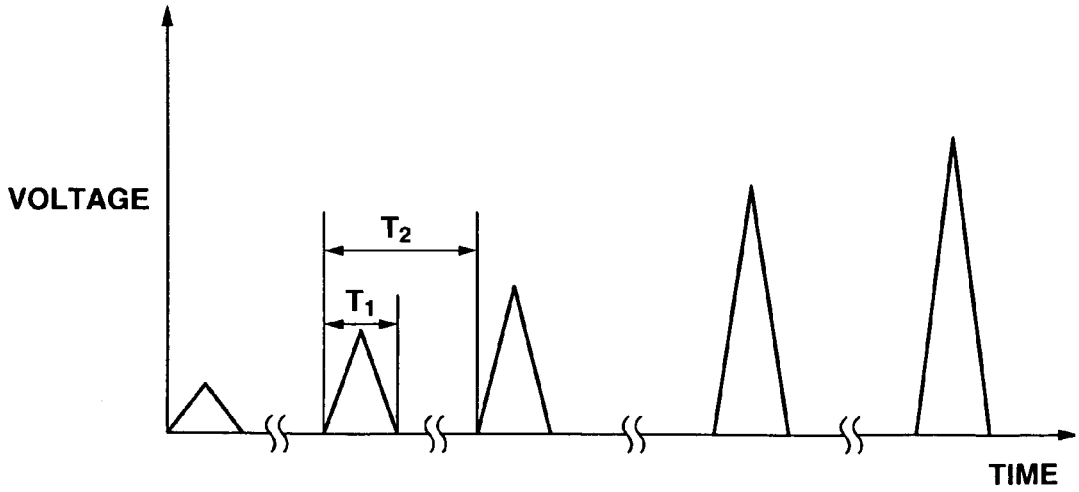

The applied voltage preferably has the waveform of a pulse. The pulse voltage may be continuously applied by maintaining the peak value constant, or may be applied by increasing the peak value. $T_1$ and $T_2$ shown in FIG. 6A represent a pulse width and a pulse interval, respectively. Usually, $T_1$ is set within a range of 1 μsec-10 msec, and $T_2$ is set within a range of 10 μsec-10 msec. The peak value of a triangular wave (the peak voltage during current supply forming) is appropriately selected in accordance with the configuration of the electron emitting device. A voltage is applied, for example, for several seconds to several tens of minutes under the above-described conditions. The pulse waveform is not limited to a triangular wave, but any other desired waveform, such as a rectangular wave or the like, may also be adopted. $T_1$ and $T_2$ shown in FIG. 6B may be the same ones as those shown in FIG. 6A. The peak value (the peak voltage during current-supply forming) of the triangular wave may be increased, for example, by a step of 0.1 V. The current-supply forming is terminated when, for example, a resistance corresponding to about 0.1 V is obtained during the pulse interval $T_2$.

It is preferable to perform processing called activation processing for the device subjected to the forming. In the activation processing, the device current $I_f$ and the emission current $I_e$ greatly change. The activation processing may, for example, be performed by repeating application of a pulse voltage as in the current-supply forming in an atmosphere containing an organic gas. Such an atmosphere can be obtained by introducing an appropriate organic gas into a vacuum obtained by sufficiently evacuating the inside of the envelope 88 by an ion pump or the like. A preferable pressure of the organic gas at that time is appropriately set, because it depends on the type of application, the shape of the envelope 88, the type of the organic substance, and the like. The appropriate organic substance may be selected from aliphatic hydrocarbons, such as alkene and alkyne, aromatic hydrocarbons, alcohols, aldehydes, ketones, amines, phenol, organic acids, such as carboxylic acid and sulfonic acid, and the like. More specifically, a saturated hydrocarbon represented by a composition formula of $C_nH_{2n+2}$, such as methane, ethane, propane or the like, an unsaturated hydrocarbon represented by a composition formula of $C_nH_{2n}$, such as ethylene, propylene or the like, benzene, toluene, methanol, ethanol, formaldehyde, acetaldehyde, acetone, methyl ethyl ketone, methylamine, eithylamine, phenol, formic acid, acetic acid, propionic acid, or a mixture of some of these substances preferably may be used.

According to this processing, carbon films 19 (as shown in FIGS. 4A and 4B) are deposited from the organic substance present in the atmosphere on the portions of the conductive films 19, and the device current $I_f$ and the emission current $I_e$ greatly change. The termination of the activation processing is appropriately determined while measuring the device current $I_f$ and the emission current $I_e$. The pulse width, the pulse interval, the peak value of the pulse, and the like are appropriately set. The carbon film comprises, for example, graphite (containing so-called HOPG, PG and GC, where HOPG indicates a state of graphite having a substantially perfect crystal structure, PG indicates a state of graphite having a slightly disturbed crystal structure with a crystal grain of about 20 nm, and GC indicates a state of graphite having a further disturbed crystal structure with a crystal grain of about 2 nm), or non-crystalline carbon (indicating amorphous carbon, and a mixture of amorphous carbon and graphite crystallites), and preferably has a thickness equal to or less than 50 nm, and more preferably has a thickness equal to or less than 30 nm.

After sufficiently evacuating the inside of the envelope 88, the organic substance is introduced into the envelope 88 from the gas introducing line 138. Alternatively, an organic substance remaining in a vacuum atmosphere after evacuating the inside of the envelope 88 using an oil diffusion pump or a rotary pump may be introduced from line 138. In some embodiments, a substance other than the organic substance is introduced whenever necessary. By applying a voltage to each electron emitting device in the atmosphere containing the organic substance obtained in the above-described manner, carbon, a carbon compound, or a mixture of carbon and a carbon compound is deposited on the portions of the conductive films 19 (as shown in FIGS. 4A and 4B), and the amount of electron emission drastically increases. In the voltage application, voltage pulses may be simultaneously applied to devices connected to wires of one direction connected in the same manner as in the case of the forming.

It is preferable to perform stabilization processing after completing the activation processing. In this processing, the organic substance within the envelope 88 is exhausted. The partial pressure of the organic substance within the envelope 88 in this processing is set to a value with which the above-described carbon and carbon compound are substantially not newly deposited, and preferably is equal to or less than $1.3 \times 10^{-6}$ Pa, and more preferably is equal to or less than $3\times10^{-8}$ Pa. When evacuating the inside of the envelope 88, it is preferable to heat the entire envelope 88 in order to ease the exhaust of molecules of the organic substance adsorbed on the inner wall of the envelope 88, and the electron emitting devices. The heating preferably is performed at a temperature within a range of 80-250° C., preferably at least 150° C., for as long a time period as possible. However, the heating conditions are not limited to these temperatures, and any other appropriate suitable conditions may also be adopted, depending on the size and the shape of the envelope 88, the configuration of the electron emitting devices, and the like. The pressure within the envelope 88 must be as low as possible, preferably equal to or less than $1\times10^{-5}$ Pa, and even more preferably, equal to or less than $1.3\times10^{-6}$ Pa.

It is preferable to maintain the atmosphere when terminating the stabilization processing as the atmosphere during driving. However, the atmosphere is not limited to this atmosphere. If the organic substance is sufficiently removed, sufficiently stable characteristics can be maintained even if the degree of vacuum is more or less degraded. By adopting such a vacuum atmosphere, it is possible to suppress new deposition of carbon or a carbon compound, remove $H_2O$, $O_2$ and the like absorbed on the envelope 88, the substrate and the like, and, as a result, to stabilize the device current $I_f$ and the emission current $I_e$.

After providing the desired pressure, the exhaust tube 132 is sealed by being heated and melted by a burner. Gettering processing may be performed in order to maintain the pressure within the envelope 88 after the sealing (coupling of 86, 82 and 81). In this processing, a vacuum deposited film is formed by heating a getter (not shown) disposed at a predetermined position within the envelope 88 according to resistance heating, high-frequency heating or the like, immediately before or after the sealing of the envelope 88. Usually, the getter contains Ba as a main component, and maintains the atmosphere within the envelope 88 according to an absorption function of the vacuum deposited film.

When disposing the getter, it is preferable to provide the first layer 7 and the second layer 6 on the substrate 1 (as shown in FIG. 1), except for a region 100 of the substrate 1 where the getter is disposed.

As described above, in the precursor to an electron source according to the present invention, since the first layer 7 and the second layer 6 are formed, it is possible to prevent degradation of characteristics of the electron source caused by diffusion of Na from the substrate into the electron emitting devices 76.

Furthermore, since the second layer 6 and the first layer 7 are formed on the substrate 1, except for a region of the substrate 1 which is sealed to a supporting member 82 and/or a region where the getter film is disposed, the supporting frame 82 is directly connected to the glass surface of the substrate 1, using frit at the sealing region. Hence, air is not leaked from the second layer 6 containing voids into the envelope 88. As a result, the degree of vacuum within the envelope 88 does not decrease with time, so that the life of the electron source can be prolonged.

By providing the first layer 7 and the second layer 6 on the surface of the substrate 1 where the electron emitting devices 76 are to be disposed, but not on a region 100 of the substrate 1 where the getter film is disposed, bubbles are not generated within the insulating layer even if heating processing as high as 300° C. is performed at post-processing, and short-circuiting between adjacent wire electrodes 73 via the getter due to formation of the getter film caused by exposure to the wire electrodes 73 from insulating layer 101 cannot occur.

While the present invention has been described with respect to what are presently considered to be the preferred embodiments, it is to be understood that the scope of the invention is not limited to only the disclosed embodiments. To the contrary, the present invention is intended to cover various modifications and equivalent arrangements included within the spirit and scope of the appended claims. The scope of the following claims is to be accorded the broadest reasonable interpretation so as to encompass all such modifications and equivalent structures and functions.

What is claimed is:

1. An electron source comprising:

a precursor to an electron source, said precursor being one on which electron emitting devices and a supporting frame coupled to an image display member to form an image display apparatus are to be disposed, said precursor comprising a substrate, a first insulating film containing a metal oxide provided on a surface of said substrate in an area except for a partial surface area of said substrate, and a second insulating film provided on said first insulating film so as to cover said metal oxide, wherein said second insulating film has a surface on which said electron emitting devices are to be disposed, and said partial surface area is an area in which said supporting frame is to be disposed; and electron emitting devices disposed on said precursor.

2. An electron source comprising:

a precursor to an electron source, said precursor being one on which electron emitting devices and a supporting frame coupled to an image display member to form an image display apparatus are to be disposed, said precursor comprising a substrate, a first $SiO_2$ film containing a metal oxide provided on a surface of said substrate in an area except for a partial surface area of said substrate, and a second $SiO_2$ film provided on said first $SiO_2$ film so as to cover said metal oxide, wherein said second $SiO_2$ film has a surface on which said electron emitting devices are to be disposed, and said partial surface area is an area in which said supporting frame is to be disposed; and electron emitting devices disposed on said precursor.

3. An electron source comprising:

a precursor to an electron source, said precursor being one on which electron emitting devices and a getter film are to be disposed, said precursor comprising a substrate; and an insulating film containing a metal oxide provided on a surface of said substrate in an area except for a partial surface area of said substrate, wherein said insulating film containing metal oxide has a surface on which said electron emitting devices are to be disposed, and said partial surface area is an area in which said getter film is to be disposed; and electron emitting devices disposed on said precursor.

4. An electron source comprising:

a precursor to an electron source, said precursor being one on which electron emitting devices and a getter film are to be disposed, said precursor comprising a substrate, and a $SiO_2$ film containing a metal oxide provided on a surface of said substrate in an area except for a partial surface area of said substrate, wherein said $SiO_2$ film containing metal oxide has a surface on which said electron emitting devices are to be disposed, and said partial surface area is an area in which said getter film is to be disposed; and electron emitting devices disposed on said precursor.

5. An electron source according to claim 4, further comprising another film including $SiO_2$ laminated on said $SiO_2$ film.

6. An electron source comprising:

a precursor to an electron source, said precursor being one on which electron emitting devices, a getter film and a supporting frame coupled to an image display member to form an image display apparatus are to be disposed, said precursor comprising a substrate, and an insulating film containing a metal oxide provided on a surface of said substrate in an area except for a partial surface area of said substrate, wherein said insulating film containing metal oxide has a surface on which said electron emitting devices are to be disposed, and said partial surface area is an area in which said supporting frame and the getter film are to be disposed; and electron emitting devices disposed on said precursor.

7. An electron source comprising:

a precursor to an electron source, said precursor being one on which electron emitting devices, a getter film and a supporting frame coupled to an image display member to form an image display apparatus are to be disposed, said precursor comprising a substrate, and a $SiO_2$ film containing a metal oxide provided on a surface of said substrate in an area except for a partial surface area of said substrate, wherein said $SiO_2$ film containing metal oxide has a surface on which said electron emitting devices are to be disposed, and said partial surface area is an area in which said supporting frame and the getter film are to be disposed; and electron emitting devices disposed on said precursor.

8. An electron source according to claim 7, further comprising another film including $SiO_2$ disposed on said $SiO_2$ film.

9. An image display device, comprising:

an electron source, comprising a precursor to an electron source, said precursor being one on which electron emitting devices and a supporting frame coupled to an image display member to form an image display apparatus are to be disposed, said precursor comprising a substrate, a first insulating film containing a metal oxide provided on a surface of said substrate in an area except for a partial surface area of said substrate, and a second insulating film provided on said first insulating film so as to cover said metal oxide, wherein said second insulating film has a surface on which said electron emitting devices are to be disposed, and said partial surface area is an area in which said supporting frame is to be disposed;

electron emitting devices disposed on said precursor; and an image display member for displaying an image in response to being irradiated by electrons emitted from said electron emitting devices.

10. An image display device, comprising:

an electron source, comprising a precursor to an electron source, said precursor being one on which electron emitting devices and a supporting frame coupled to an image display member to form an image display apparatus are to be disposed, said precursor comprising:

a substrate, a first $SiO_2$ film containing a metal oxide provided on a surface of said substrate in an area except for a partial surface area of said substrate, and a second $SiO_2$ film provided on said first $SiO_2$ film so as to cover said metal oxide, wherein said second $SiO_2$ film has a surface on which said electron emitting devices are to be disposed, and said partial surface area is an area in which said supporting frame is to be disposed;

electron emitting devices disposed on said precursor; and an image display member for displaying an image in response to being irradiated by electrons emitted from said electron emitting devices.

11. An image display device, comprising:

an electron source, comprising a precursor to an electron source, said precursor being one on which electron emitting devices and a getter film are to be disposed, said precursor comprising a substrate, and an insulating film containing a metal oxide provided on a surface of said substrate in an area except for a partial surface area of said substrate, wherein said insulating film containing metal oxide has a surface on which said electron emitting devices are to be disposed, and said partial surface area is an area in which said getter film is to be disposed;

electron emitting devices disposed on said precursor; and an image display member for displaying an image in response to being irradiated by electrons emitted from said electron emitting devices.

12. An image display device, comprising:

an electron source, comprising a precursor to an electron source, said precursor being one on which electron emitting devices and a getter film are to be disposed, said precursor comprising a substrate, and a $SiO_2$ film containing a metal oxide provided on a surface of said substrate in an area except for a partial surface area of said substrate, wherein said $SiO_2$ film containing metal oxide has a surface on which said electron emitting devices are to be disposed, and said partial surface area is an area in which said getter film is to be disposed;

electron emitting devices disposed on said precursor; and an image display member for displaying an image in response to being irradiated by electrons emitted from said electron emitting devices.

13. An image display device according to claim 12, further comprising another film including $SiO_2$ laminated on said $SiO_2$ film.

14. An image display device, comprising:

an electron source, comprising a precursor to an electron source, said precursor being one on which electron emitting devices, a getter film and a supporting frame coupled to an image display member to form an image display apparatus are to be disposed, said precursor comprising a substrate, and an insulating film containing a metal oxide provided on a surface of said substrate in an area except for a partial surface area of said substrate, wherein said insulating film containing metal oxide has a surface on which said electron emitting devices are to be disposed, and said partial surface area is an area in which said supporting frame and the getter film are to be disposed;

electron emitting devices disposed on said precursor; and an image display member for displaying an image in response to being irradiated by electrons emitted from said electron emitting devices.

15. An image display device, comprising an electron source, comprising a precursor to an electron source, said precursor being one on which electron emitting devices, a getter film and a supporting frame coupled to an image display member to form an image display apparatus are to be disposed, said precursor comprising a substrate, and a $SiO_2$ film containing a metal oxide provided on a surface of said substrate in an area except for a partial surface area of said substrate, wherein said $SiO_2$ film containing metal oxide has a surface on which said electron emitting devices are to be disposed, and said partial surface area is an area in which said supporting frame and the getter film are to be disposed;

electron emitting devices disposed on said precursor; and an image display member for displaying an image in response to being irradiated by electrons emitted from said electron emitting devices.

16. An image display device according to claim 15, further comprising another film including $SiO_2$ disposed on said $SiO_2$ film.

* * * * *